US007539448B2

(12) United States Patent
Miwa et al.

(10) Patent No.: US 7,539,448 B2
(45) **Date of Patent: *May 26, 2009**

(54) IMAGE-FORMING DEVICE FOR SUPPRESSING VIBRATION OF GUIDE PLATE AND JAMS OF RECORDING SHEET

(75) Inventors: Atsushi Miwa, Nagoya (JP); Hideaki Deguchi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/878,506

(22) Filed: Jul. 25, 2007

(65) Prior Publication Data

US 2007/0269244 A1 Nov. 22, 2007

Related U.S. Application Data

(63) Continuation-in-part of application No. 11/340,539, filed on Jan. 27, 2006.

(30) Foreign Application Priority Data

Jan. 28, 2005 (JP) ..... P2005-021992
Jan. 28, 2005 (JP) ..... P2005-021993
Jul. 25, 2006 (JP) ..... P2006-202199

(51) Int. Cl.
*G03G 15/16* (2006.01)

(52) U.S. Cl. ..... 399/316; 399/317

(58) Field of Classification Search ..... 399/316, 399/317

See application file for complete search history.

(56) References Cited

U.S. PATENT DOCUMENTS 4,882,606 A * 11/1989 Deguchi ..... 399/316
5,144,383 A * 9/1992 Murano et al. ..... 399/316
5,155,539 A * 10/1992 Yamaguchi et al. ..... 399/317
5,220,396 A * 6/1993 Monma et al. ..... 399/121
5,592,278 A * 1/1997 Sato et al. ..... 399/384
2005/0069343 A1 3/2005 Deguchi et al.

(Continued)

FOREIGN PATENT DOCUMENTS

CN 1073534 A 6/1993

(Continued)

OTHER PUBLICATIONS

European Search Report issued in European Patent Application No. EP 06 00 1618 dated May 15, 2006.

(Continued)

*Primary Examiner*—David M Gray
*Assistant Examiner*—Ryan D Walsh
(74) *Attorney, Agent, or Firm*—McDermott Will & Emery LLP

(57) ABSTRACT

An image-forming device includes a photosensitive drum, a transfer roller, a guide plate for guiding the paper toward the photosensitive drum, and a seat for supporting one end portion of the guide plate, for allowing another end portion of the guide plate to be deformable. A sponge is fixed to the bottom surface of the guide plate to expose at least the deformation part, so that the sponge can reduce the occurrence of paper jams. The sponge absorbs vibrations in the guide plate.

26 Claims, 12 Drawing Sheets

U.S. PATENT DOCUMENTS

| | | | | |
|---|---|---|---|---|
| 2006/0171760 | A1 | 8/2006 | Deguchi | |
| 2007/0269242 | A1* | 11/2007 | Hattori et al. | 399/316 |
| 2007/0269243 | A1* | 11/2007 | Uehara et al. | 399/316 |

FOREIGN PATENT DOCUMENTS

| | | | |
|---|---|---|---|
| EP | 0549089 | A1 | 6/1993 |
| EP | 1 031 891 | A | 8/2000 |
| JP | 59-206846 | | 11/1984 |
| JP | 63-43473 | | 3/1988 |
| JP | 2-136269 | U | 11/1990 |
| JP | 7-160129 | | 6/1995 |
| JP | 7-181815 | | 7/1995 |
| JP | 8-36313 | | 2/1996 |
| JP | 11-338279 | | 12/1999 |
| JP | 2002-072704 | | 3/2002 |
| JP | 2003-5535 | | 1/2003 |
| JP | 2006-208839 | | 8/2006 |
| JP | 2006-208840 | | 8/2006 |

OTHER PUBLICATIONS

Chinese Office Action with English translation issued in Chinese Patent Application No. 2006100071765, dated Jun. 27, 2008.

* cited by examiner

IMAGE-FORMING DEVICE FOR SUPPRESSING VIBRATION OF GUIDE PLATE AND JAMS OF RECORDING SHEET

CROSS REFERENCE TO RELATED APPLICATION

This application is a continuation-in-part application of application Ser. No. 11/340,539 filed Jan. 27, 2006, claiming priorities from Japanese patent application Nos. 2005-21992 and 2005-21993 both filed Jan. 28, 2005. This application further claims priority from Japanese Patent Application No. 2006-202199 filed Jul. 25, 2006. The entire contents of these priority applications are incorporated herein by reference.

BACKGROUND OF THE INVENTION

1. Field of the Invention

The present invention relates to an image-forming device such as a laser printer, and to a process cartridge detachably provided in the image-forming device.

2. Description of the Related Art

Generally, laser printers and other electrophotographic image-forming devices are provided with a photosensitive drum for carrying a developer image, and a transfer roller disposed in contact with the photosensitive drum for attracting the developer image with a transfer bias applied to the transfer roller. When a sheet of paper passes between the photosensitive drum and the transfer roller, the developer image migrates toward the transfer roller and is transferred onto the paper, forming an image thereon. However, when the paper is separated from the photosensitive drum at a position upstream of a transfer position between the photosensitive drum and the transfer roller with respect to the paper-conveying direction, a pre-transfer may occur in which an electric field produced between the paper and the photosensitive drum causes developer to scatter from the photosensitive drum onto the paper.

To resolve this problem, a guide plate has conventionally been provided on the upstream side of the transfer position for guiding the paper toward the photosensitive drum in order to suppress pre-transfer. This technology is disclosed in Japanese unexamined patent application publication No. 2003-5535.

However, when the guide plate is formed of a film or other flexible member in the technology described above, the guide plate bent by the paper returns to its original position and flaps when the trailing edge (upstream end) of the paper leaves the guide plate, potentially generating noise (referred to as "flapping").

SUMMARY OF THE INVENTION

Therefore, it is an object of the present invention to provide an image-forming device and a process cartridge capable of suppressing flapping noise in the guide plate and reducing the occurrence of paper jams by damping vibrations in the guide plate while ensuring that the plate is flexible.

The above and other objects will be attained by an image-forming device that includes an image-carrying member, a transferring unit, a guide plate, a seat, and a cushioning member. The image-carrying member carries a developer image. The transferring unit is disposed in confrontation with the image-carrying member and transfers the developer image on the image-carrying member to a recording sheet. The conveying unit conveys the recording sheet to a transfer position between the image-carrying member and the transferring unit. The guide plate supports the recording sheet conveyed by the conveying unit on the top (first) surface and guiding the recording sheet toward the image-carrying member. The upstream side edge of the guide plate is fixed to the seat supporting the guide plate. The cushioning member is disposed at a side of the bottom surface of the guide plate. The cushioning member is formed from a material softer than a material of the guide plate. The guide plate is disposed locally on the bottom surface to expose at least a part between the downstream side edge and the upstream side edge portion.

When the image-carrying member is a photosensitive drum, this photosensitive drum may be provided in a process cartridge that is detachably mounted in the image-forming device. In this case, the guide plate and the cushioning member may also be provided in the process cartridge.

By providing a cushioning member that is disposed on the bottom surface of the guide plate, the cushioning member can absorb vibrations in the guide plate when the trailing edge of the paper leaves the guide plate. Further, the cushioning member is disposed locally on the bottom surface to expose at least a part between the downstream side edge and the upstream side edge portion. The guide plate can retain flexibility in the exposed portion of the cushioning member. More specifically, it is possible to adjust the guide plate to a suitable flexibility by adjusting the size of the area of the guide plate on which the cushioning member is provided and the size of the area on which the cushioning member is not provided.

The problem described above may also be resolved by adjusting the thickness of the cushioning member provided on the guide plate in the direction for conveying a sheet, or by providing two or more types of cushioning members having different levels of softness.

Since the cushioning member of the present invention can absorb vibrations in the guide plate, the structure of the present invention can suppress flapping noise from the guide plate. Further, by providing the cushioning member on the guide plate to expose at least a part between the downstream side edge and the upstream side edge portion, the guide plate can retain its flexibility in order to reduce the occurrence of paper jams.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Next, a preferred embodiment of the present invention will be described.

Figure 1:
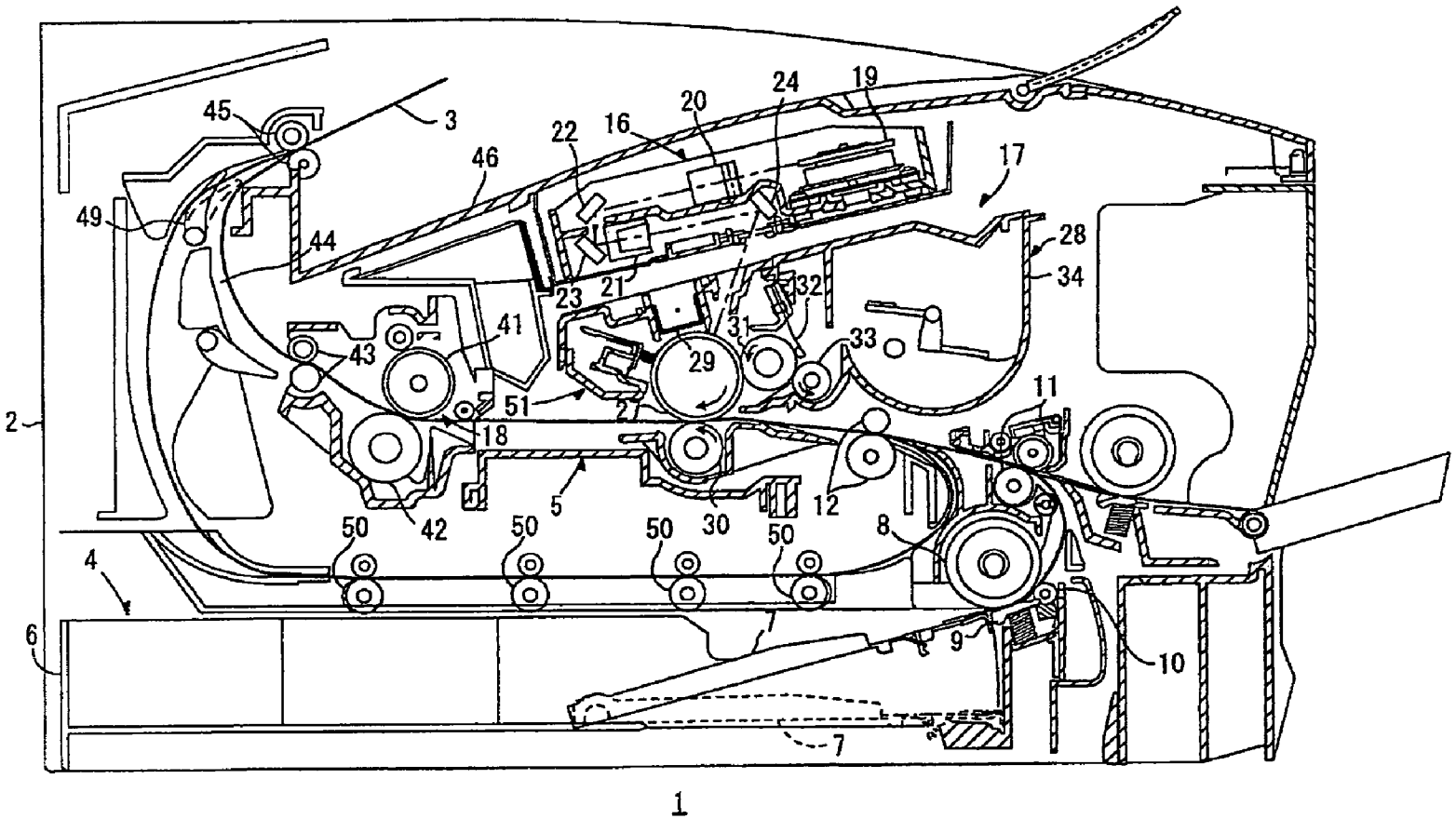
FIG. 1 is a side cross-sectional view of a laser printer serving as a preferred embodiment of the image-forming device according to the present invention.

First, the overall structure of a laser printer will be briefly described as an example of the image-forming device according to the present invention. FIG. 1 is a side cross-sectional view of a laser printer 1 serving as a preferred embodiment of the image-forming device according to the present invention. As shown in FIG. 1, the laser printer 1 includes a main casing 2 and, within the main casing 2, a feeding unit 4 for feeding sheets of a paper 3, and an image-forming unit 5 for forming images on the paper 3 supplied by the feeding unit 4.

The feeding unit 4 includes a paper tray 6 detachably mounted in the bottom section of the main casing 2, a paper-pressing plate 7 provided inside the paper tray 6, a feeding roller 8 and a feeding pad 9 disposed above one end of the paper tray 6, paper dust rollers 10 and 11 disposed downstream of the feeding roller 8 in the conveying direction of the paper 3, and registration rollers 12 disposed downstream of the paper dust rollers 10 and 11. In the following description, upstream or downstream in the paper-conveying direction may simply be referred to as "upstream" or "downstream," and the upstream edge or downstream edge of the sheet of paper 3 being conveyed may be referred to as the "trailing edge" or the "front edge," respectively.

In the feeding unit 4 having the construction described above, sheets of the paper 3 are loaded in the paper tray 6 and pressed toward the feeding roller 8 side by the paper-pressing plate 7. The paper 3 fed one sheet at a time by the feeding roller 8 and feeding pad 9 pass through the various rollers 10-12 and are conveyed by these rollers to the image-forming unit 5 (specifically, a transfer position C shown in FIG. 2).

The image-forming unit 5 includes a scanning unit 16, a process cartridge 17, and a fixing unit 18.

The scanning unit 16 is disposed in the upper section of the main casing 2 and includes a laser light-emitting element (not shown), a polygon mirror 19 that is driven to rotate, lenses 20 and 21, and reflecting mirrors 22, 23, and 24. The laser light-emitting element emits a laser beam based on image data. As indicated by the dotted line in FIG. 1, the laser beam sequentially passes through or is reflected off the polygon mirror 19, lens 20, reflecting mirror 22, reflecting mirror 23, lens 21, and reflecting mirror 24, and is irradiated in a high-speed scan onto the surface of a photosensitive drum 27 in the process cartridge 17 described next.

The process cartridge 17 is disposed beneath the scanning unit 16 and is constructed to be detachably mounted in the main casing 2. The outer frame of the process cartridge 17 is configured of a hollow casing 51, within which are primarily provided a developer cartridge 28, the photosensitive drum 27, a Scorotron charger 29, and a transfer roller 30.

The developer cartridge 28 is detachably mounted in the casing 51 and includes a developing roller 31, a thickness-regulating blade 32, a supply roller 33, and a toner hopper 34. The supply roller 33 rotates in the direction of the arrow (counterclockwise in FIG. 1) to supply toner from the toner hopper 34 to the developing roller 31. At this time, the toner is positively tribocharged between the supply roller 33 and developing roller 31. As the developing roller 31 rotates in the direction of the arrow (counterclockwise in FIG. 1), toner supplied onto the developing roller 31 passes between the developing roller 31 and the thickness-regulating blade 32 and is regulated to a thin film of a fixed thickness on the developing roller 31.

The photosensitive drum 27 is supported in the casing 51 so as to be capable of rotating in the direction of the arrow (clockwise in FIG. 1). The photosensitive drum 27 is configured of a main drum body that is grounded, and a positive-charging photosensitive layer of polycarbonate formed on the surface thereof.

The charger 29 is disposed above and in confrontation with the photosensitive drum 27 but separated a prescribed distance therefrom so as not to contact the photosensitive drum 27. The charger 29 is a positive-charging Scorotron charger that produces a corona discharge from a charging wire formed of tungsten or the like for charging the surface of the photosensitive drum 27 with a uniform positive polarity.

The transfer roller 30 is disposed below the photosensitive drum 27, confronting and contacting the same, and is supported in the casing 51 so as to be capable of rotating in the direction of the arrow (counterclockwise in FIG. 1). The transfer roller 30 is configured of a metal roller shaft coated with an electrically conductive rubber material. During a transfer operation, a transfer bias is applied to the transfer roller 30 through constant current control. A transfer position C (see FIG. 2) is formed at the point of contact between the transfer roller 30 and photosensitive drum 27 (nip point).

After the charger 29 charges the surface of the photosensitive drum 27 with a uniform positive polarity, the scanning unit 16 irradiates a laser beam in a high-speed scan over the surface of the photosensitive drum 27 based on image data. The areas of the photosensitive drum 27 exposed to the laser beam have a lower potential and form an electrostatic latent image. Here, the "electrostatic latent image" indicates areas on the surface of the photosensitive drum 27 carrying a uniformly positive charge that were exposed to the laser beam and, therefore, have a lower potential. As the developing roller 31 rotates, the toner carried on the developing roller 31 confronts and contacts the photosensitive drum 27, at which time toner is supplied to the electrostatic latent image formed on the surface of the photosensitive drum 27. The toner is selectively transferred to and carried on the surface of the photosensitive drum 27, developing the latent image into a visible image through reverse development to form a toner image on the photosensitive drum 27.

Figure 2:
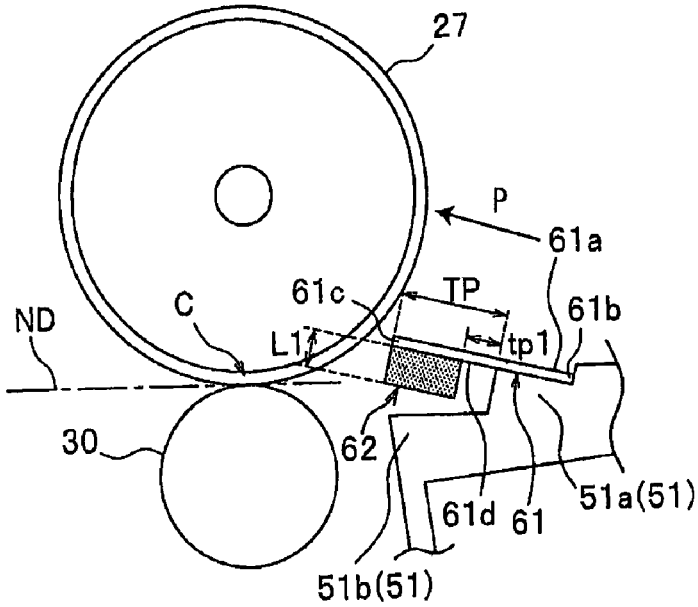
FIG. 2 is a cross-sectional view showing a simplified structure near a transfer position in the laser printer of FIG. 1.

As the photosensitive drum 27 and transfer roller 30 are driven to rotate, a sheet of the paper 3 is pinched between the photosensitive drum 27 and transfer roller 30 at the transfer position C shown in FIG. 2. The photosensitive drum 27 and transfer roller 30 convey the sheet of paper 3 while the toner image carried on the surface of the photosensitive drum 27 is transferred onto the paper 3.

The fixing unit 18 is disposed on the downstream side of the process cartridge 17 and includes a heating roller 41, a pressure roller 42 disposed in confrontation with the heating roller 41 and applying pressure to the same, and a pair of conveying rollers 43 disposed downstream of the heating roller 41 and pressure roller 42. The fixing unit 18 having this construction fixes the toner transferred onto the paper 3 with heat as the paper 3 passes between the heating roller 41 and pressure roller 42. Subsequently, the conveying rollers 43 convey the sheet of paper 3 along a discharge path 44. Discharge rollers 45 receive the paper 3 conveyed along the discharge path 44 and discharge the paper 3 onto a discharge tray 46. Alternatively, the sheet of paper 3 may be returned into the device by reversing the rotation of the discharge rollers 45 and switching a flapper 49. In this case, a plurality of reverse conveying rollers 50 convey the sheet of paper 3 in an inverted state back to the upstream side of the image-forming unit 5 to perform a duplex print.

Next, the structure of the area near the transfer position C, which structure is a feature of the present invention, will be described in greater detail. FIG. 2 is a side cross-sectional view showing a simplified structure near the transfer position C in the laser printer of FIG. 1. Some parts in the structure around the transfer position C in FIG. 1 have been omitted for the convenience of description.

As shown in FIG. 2, a guide plate 61 for guiding the paper 3 toward the photosensitive drum 27, and a sponge 62 are sequentially disposed with respect to the paper-conveying direction on the upstream side of the contact point (transfer position C) between the photosensitive drum 27 and transfer roller 30.

The guide plate 61 is a substantially rectangular film member formed through a pressing process or the like. Specifically, the guide plate 61 is formed of a flexible insulating material, such as polyethylene terephthalate or another resin. A top surface 61*a* of the guide plate 61 is sloped upward and the recording sheet is conveyed along the top surface 61*a*. Here in after, the term "paper conveying direction P" will be used to refer to a direction in which the recording sheet is conveyed along the top surface 61*a* of the guide plate 61. A base end portion 61*b* on the upstream end of the guide plate 61 is fixed to a first seat 51*a*. With the guide plate 61 fixed in a sloped state by the first seat 51*a* as described above, a downstream end 61*c* of the guide plate 61 is swingably supported about the base end portion 61*b* while constantly extending toward the photosensitive drum 27.

The top surface of the first seat 51*a* has a stepped shape in which the region upstream of the region fixing the guide plate 61 is raised an amount greater than or equal to the thickness of the guide plate 61 to prevent paper jams. A second seat 51*b* is formed along the bottom of the first seat 51*a*, and extends toward the transfer position C. The top surface of the second seat 51*b* extends in parallel with a reference plane that is orthogonal to a plane including the rotation axes of the photosensitive roller 27 and the transfer roller 30 and the transfer position C.

The guide plate 61 is fixed on the first seat 51*a* at a slope to the nip conveying direction ND (parallel to the guide plate 61) or the reference plane. The "nip conveying direction ND" is the direction in which the image-carrying member and the transferring unit convey the recording sheet. When the image-carrying member and the transferring unit are both configured of rollers, as in the preferred embodiment, the nip conveying direction ND is the direction along a common tangent to both rollers when viewed from the side (a direction orthogonal to a line connecting the axes of the two rollers). Further, the portion of the guide plate 61 protruding from the downstream edge of the first seat 51*a* is a deformable region TP capable of flexural deformation. The "deformable region TP" is a part between the downstream end 61*c* and the base end portion 61*b*. The portion of the guide plate 61 other than the deformable region TP is fixed to the first seat 51*a* and therefore is incapable of flexural deformation.

The first and second seats 51*a* and 51*b* constitute parts of the casing 51. The first and second seats 51*a* and 51*b* may be configured separately from each other or configured separately from the casing 51. Here, the first and second seats 51*a* and 51*b* are immovably fixed in the laser printer 1 when the process cartridge 17 is mounted and immovably fixed in the laser printer 1.

The sponge 62 is a porous member that is softer than the guide plate 61 and has a rectangular cross-sectional shape. It is preferable that the shape of the sponge 62 be symmetrical with respect to a center plane orthogonal to the top surface 61*a* and including a center line between the side edges. The sponge 62 is fixed to a bottom surface 61*d* on the downstream end 61*c* of the guide plate 61 so that a portion tp1 of the deformable region TP is not fixed to the sponge 62. In other words, the sponge 62 is disposed locally on the bottom surface 61*d* of guide plate 61 to expose the region tp1 of the deformable region TP.

The structure of the preferred embodiment described above has the following effects.

The sponge 62 provided on the guide plate 61 absorbs vibrations in the guide plate 61 generated when the trailing edge of the paper 3 leaves the guide plate 61, thereby suppressing flapping noise by the guide plate 61.

By providing the sponge 62 on the guide plate 61 so as to expose the portion tp1 of the deformable region TP, the guide plate 61 can retain its flexibility through the portion tp1, thereby reducing the likelihood of paper jams.

Since the guide plate 61 can be a source of flapping noise, providing the sponge 62 on the downstream end 61*c* of the guide plate 61 can effectively absorb such flapping noise.

By using the readily deformable sponge 62 as the cushioning member, the guide plate 61 can be suitably bent when printing on a thick sheet of paper 3, thereby reducing the likelihood of paper jams. Further, the sponge 62 used as the cushioning member can absorb noise in the pores formed therein, thereby further enhancing the sound-absorbing effect.

While the invention has been described in detail with reference to specific embodiments thereof, it would be apparent to those skilled in the art that many modifications and variations may be made therein without departing from the spirit of the invention, the scope of which is defined by the attached claims.

For example, the present invention is not limited to the preferred embodiment described above, but may be applied to any of the following structures for the vicinity of the transfer position.

Figure 3:
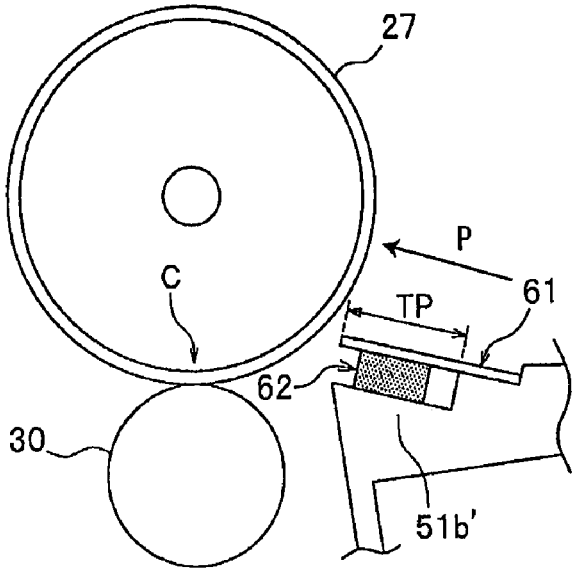
FIG. 3 is a cross-sectional view showing the structure near the transfer position according to a variation 1A.

FIG. 3 shows the structure around the transfer position C according to a variation 1A in which the sponge 62 according to the first embodiment is fixed to a second seat 51*b*'. Specifically, the sponge 62 is fixed to the guide plate 61 and fixed to the second seat 51*b*' so as to leave portions of the guide plate 61 uncovered in the upstream and downstream ends of the deformable region TP. The top surface of the second seat 51*b*' is formed substantially parallel to the guide plate 61 slops relative to the nip conveying direction ND or the reference plane.

The structure according to variation 1A described above has the following effects.

By fixing the sponge 62 to the second seat 51*b*', the sponge 62 can rapidly damp vibrations in the guide plate 61. Further, since the sponge 62 is fixed to the guide plate 61 so as not to occupy the entire deformable region TP of the guide plate 61, the guide plate 61 can retain sufficient flexibility.

Figure 4A:
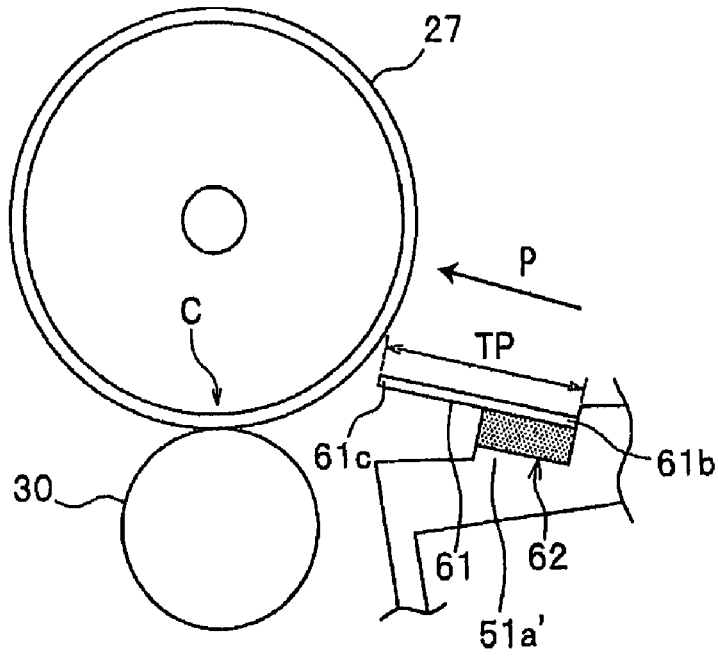
FIG. 4A is a cross-sectional view showing the structure near the transfer position according to a variation 1B.
Figure 4B:
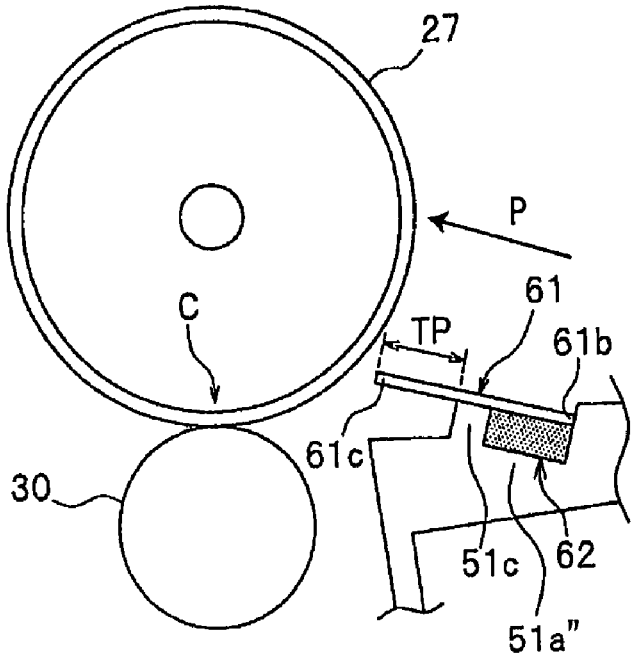
FIG. 4B is a cross-sectional view showing the structure near the transfer position according to a variation 1C.

FIGS. 4A and 4B show the structure around the transfer position C according to variations 1B and 1C. As in the variation 1A, the sponge 62 is fixed to a seat, and specifically a first seat 51*a*' formed lower than the first seat 51*a* in the first embodiment, and a first seat 51*a*" formed lower than the first seat 51*a*' in variations 1B and 1C, respectively. However, the present variations differ from variation 1A in how the guide plate 61 is fixed to the top surface of the sponge 62. More specifically, in variation 1B shown in FIG. 4A, a prescribed region of the guide plate 61 on the base end portion 61*b* side is fixed only to the sponge 62, making the entire guide plate 61 the deformable region TP. In other words, in variation 1B the sponge 62 is provided on the guide plate 61, which serves as the deformable region TP in its entirety, but does not occupy a prescribed region on the downstream end 61*c* side of the guide plate 61.

In variation 1C shown in FIG. 4B, a prescribed region of the guide plate 61 on the base end portion 61*b* side is fixed to the sponge 62, while a substantially central region of the guide plate 61 on the downstream side of the region fixed to the sponge 62 is fixed to a third seat 51*c* having the same thickness as the sponge 62. In other words, the seat 51*a*" has a recessed portion to receive the sponge 62 therein. Accordingly, the region of the guide plate 61 protruding downstream from the downstream edge of the third seat 51*c* forms the deformable region TP. Hence, in variation 1C the sponge 62 is provided on the guide plate 61, while leaving the entire deformable region TP of the guide plate 61 uncovered or exposed.

The structures according to variations 1B and 1C have the following effects.

Since the sponge 62 does not hinder flexural deformation in the guide plate 61 in the region of the distal end 61*c*, which bends the greatest distance, the guide plate 61 can bend sufficiently. Further, by providing the sponge 62 on the guide plate 61, the sponge 62 can absorb vibrations in the guide plate 61 and reduce flapping noise from the same.

Figure 5A:
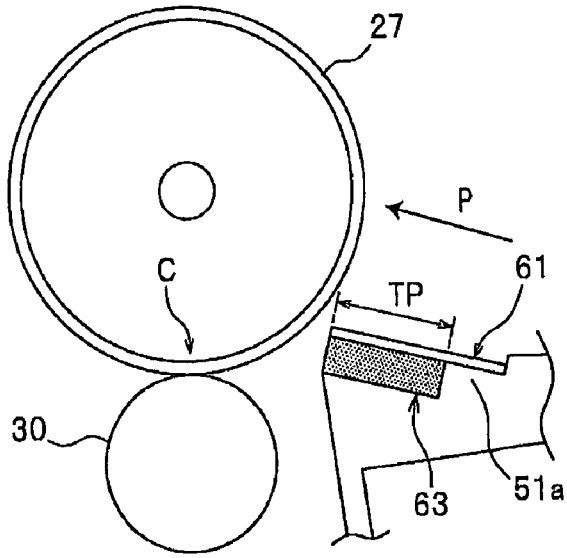
FIG. 5A is a cross-sectional view showing the structure near the transfer position according to a variation 1D.
Figure 5B:
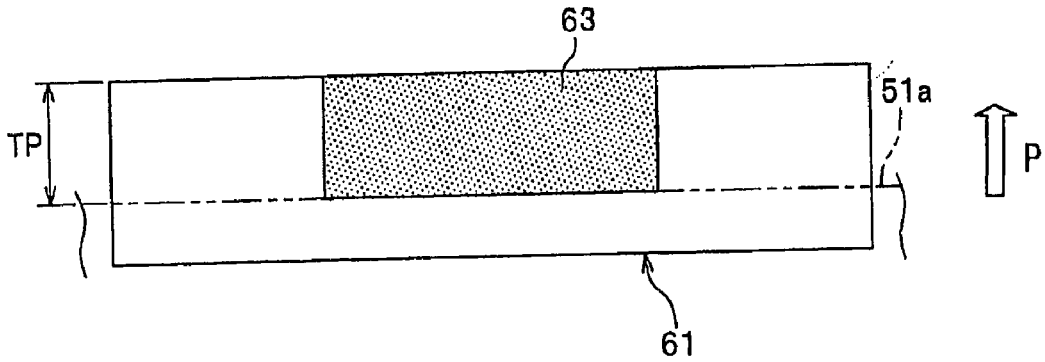
FIG. 5B is a rear view showing the structure of the guide plate according to a variation 1D.

FIGS. 5A and 5B show the structure around the transfer position C according to a variation 1D. In this structure, a sponge 63 is provided on the guide plate 61 in substantially the center of the deformable region TP with respect to a width direction (the direction parallel to the surface of the guide plate 61 and orthogonal to the paper conveying direction P). In other words, the sponge 63 is disposed at a central portion between the side edges of guide plate 61. The sponge 63 has a length in the paper conveying direction P identical to that of the deformable region TP and a width smaller than that of the deformable region TP. Hence, in variation 1D, the sponge 63 is provided on the guide plate 61 so as to leave both widthwise portions on the deformable region TP of the guide plate 61 open.

The structure according to variation 1D has the following effects.

By adjusting the widthwise dimension of the sponge 63, portions of the guide plate 61 in the deformable region TP can be left unoccupied by the sponge 63. Hence, the guide plate 61 is able to bend sufficiently, while the sponge 63 can sufficiently absorb vibrations in the guide plate 61.

Further, by providing a thinner sponge 63 in only the widthwise center of the guide plate 61, the guide plate 61 has differences in the amount of flexural deformation at different positions in the width direction, thereby changing the timing at which the paper 3 separates from the guide plate 61 between both ends and the center of the guide plate 61. As a result, this structure can reduce flapping noise in the guide plate 61 when the paper 3 leaves the same. Further, since both widthwise sides of the guide plate 61 are symmetrical about the widthwise center portion of the guide plate 61, the amount of force applied by the guide plate 61 to the paper 3 is balanced in the width direction, thereby enabling the paper 3 to be conveyed without wavering in the width direction.

By providing the thinner sponge 63 in only the widthwise center of the guide plate 61 in variation 1B, the guide plate 61 can easily bend on both widthwise ends thereof. However, the present invention is not limited to this structure. For example, it is also possible to provided two sponges, one on each widthwise end of the guide plate 61, enabling the guide plate 61 to bend easily in the widthwise center region thereof.

FIGS. 6A-6D show variations 1E-1H in which a sponge 64 (or 65) is provided with widthwise ends 64*b* (or 65*b*) that are formed longer (or shorter) in a dimension corresponding to the paper conveying direction P than the length of a widthwise center 64*a* (or 65*a*) in the same dimension. Here, the "widthwise dimension of the sponge" is a dimension corresponding to the width direction of the guide plate 61 described above, i.e. a direction parallel to the bottom surface of the guide plate 61 and orthogonal to the conveying direction P.

Figure 6A:
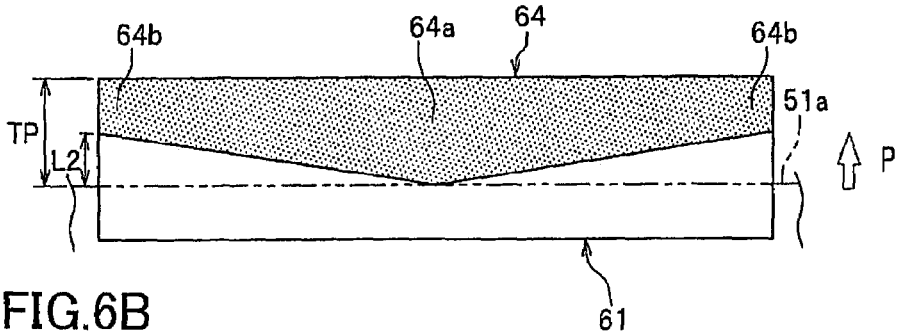
FIG. 6A is a rear view showing the structure of the guide plate according to a variation 1E.

More specifically, in variation 1E shown in FIG. 6A, the length of the sponge 64 in the paper conveying direction P grows gradually shorter from the center toward the widthwise edges, in other words, the length of the sponge 64 in the paper conveying direction P gets shorter toward the side edges from the center line between the side edges, thereby forming a chevron shape in the upstream side of the sponge 64. In variation 1E, the sponge 64 is fixed to the guide plate 61 while leaving two triangular-shaped regions in the deformable region TP of the guide plate 61 on both widthwise sides of the upstream side thereof.

Figure 6B:
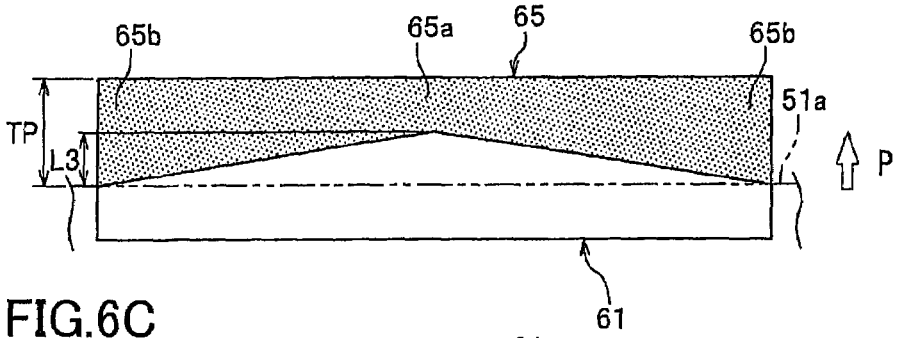
FIG. 6B is a rear view showing the structure of the guide plate according to a variation 1F.

In variation 1F shown in FIG. 6B, the length of the sponge 65 in the paper conveying direction P grows gradually longer from the center toward the widthwise edges, in other words, the length of the sponge 65 in the paper conveying direction P gets longer toward the side edges from the center line between the side edges, thereby forming a V-shaped trough in the upstream portion of the sponge 64. In variation 1F the sponge 65 is fixed to the guide plate 61 so as to leave a single triangular-shaped region in the upstream center of the deformable region TP formed in the guide plate 61.

Figure 6C:
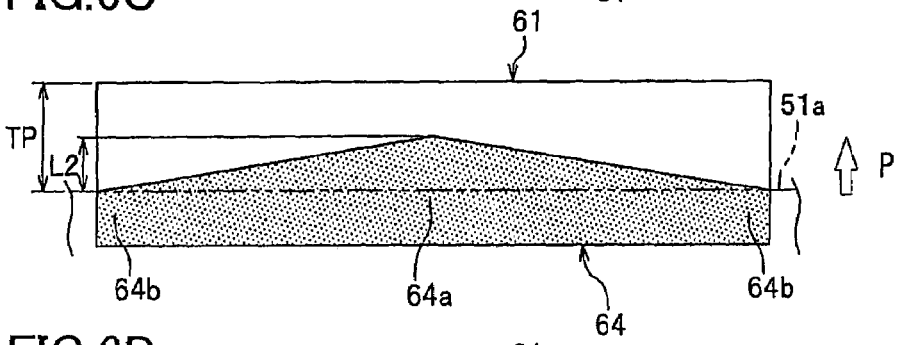
FIG. 6C is a rear view showing the structure of the guide plate according to a variation 1G.
Figure 6D:
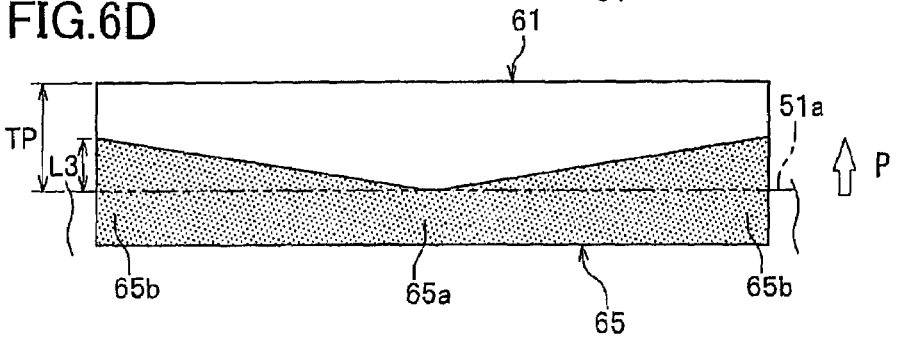
FIG. 6D is a rear view showing the structure of the guide plate according to a variation 1H.

Variations 1G and 1H shown in FIGS. 6C and 6D reverse the configurations of variations 1E and 1F shown in FIGS. 6A and 6B in the paper conveying direction P. In variations 1G and 1H, the sponges 64 and 65 are fixed to the first seat 51*a* so that the region of the deformable region TP not fixed to the sponges 64 and 65 is greater than that in variations 1E and 1F.

The structures in variations 1E-1H described above have the following effects.

By shaping the upstream and downstream sides of the sponges 64 and 65 as V-shaped chevrons or V-shaped troughs, portions of the deformable region TP in the guide plate 61 can be left unoccupied by the sponges 64 and 65, thereby enabling the guide plate 61 to bend sufficiently, while allowing the sponges 64 and 65 to suitably absorb vibrations in the guide plate 61.

Further, by forming the upstream or downstream sides of the sponges 64 and 65 in V-shaped chevron or V-shaped trough shapes, the amount of flexural deformation in the guide plate 61 is varied at different positions in the width direction, thereby varying the timing at which the paper 3 leaves the guide plate 61 between the center and widthwise sides thereof. Accordingly, the sponges 64 and 65 can reduce flapping noise in the guide plate 61 when the paper 3 leaves the same. Further, since the widthwise sides of the sponges 64 and 65 are symmetrical about the widthwise centers 64*a* and 65*a*, the force applied by the guide plate 61 to the paper 3 is balanced in the width direction, allowing the paper 3 to be conveyed without wavering in the width direction.

Figure 7A:
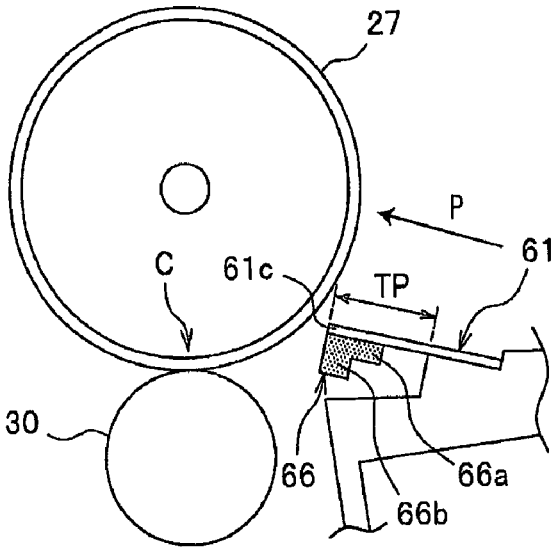
FIG. 7A is a cross-sectional view showing the structure near the transfer position according to a variation 1I.
Figure 7B:
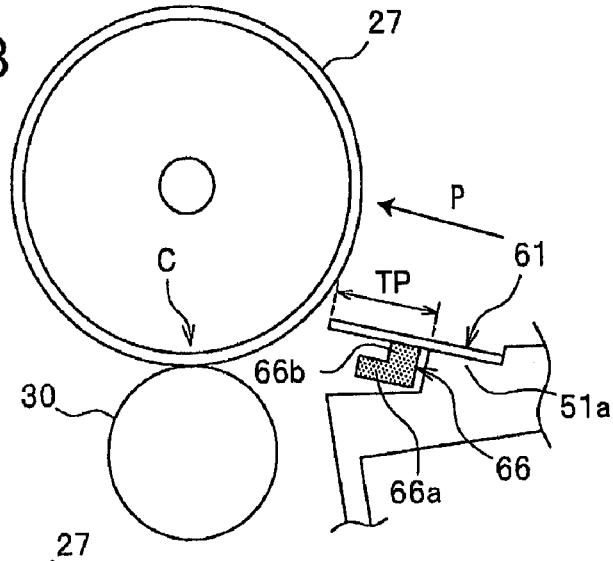
FIG. 7B is a cross-sectional view showing the structure near the transfer position according to a variation 1J.
Figure 7C:
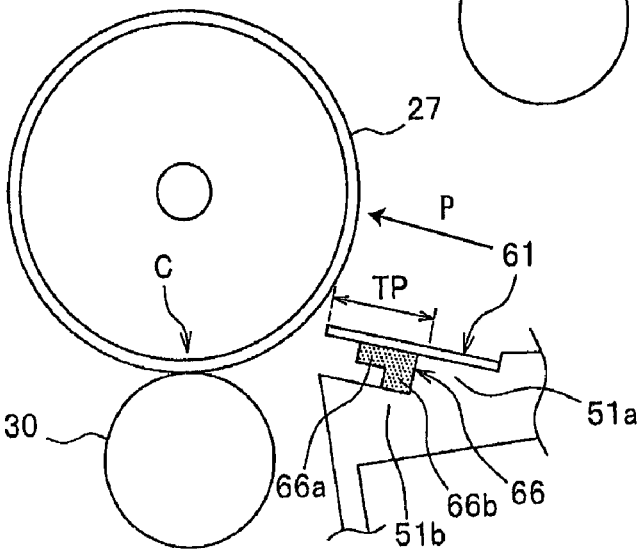
FIG. 7C is a cross-sectional view showing the structure near the transfer position according to a variation 1K.

FIGS. 7A-7C show the structure around the transfer position C according to variations 1I-1K in which the sponge 62 of the structure according to the first embodiment (see FIG. 2) is formed in a stepped shape. Specifically, a sponge 66 according to variations 1I-1K has a base part 66*a* formed in a plate shape, and a step part 66*b*. The base part 66*a* and step part 66*b* are formed with an L-shaped cross section. The base part 66*a* is upstream of the step part 66*b* with respect to the paper conveying direction P. The step part 66*b* has a thickness larger than the base part 66*a* in a direction orthogonal to the bottom surface of the guide plate 61. In variation 1I shown in FIG. 7A, the sponge 66 is provided on the downstream end 61*c* of the guide plate 61.

In variation 1J and 1K in FIG. 7B and 7C, the base part 66*a* is downstream of the step part 66*b* with respect to the paper conveying direction P. In variation 1J shown in FIG. 7B, the step part 66*b* of the sponge 66 is fixed to the guide plate 61. Further, a prescribed gap is formed between the sponge 66 and the first seat 51*a*. In variation 1K shown in FIG. 7C, the sponge 66 is fixed to the first seat 51*a* and second seat 51*b* such that the orientation of the sponge 66 is reversed in the paper conveying direction P from variation 1I in FIG. 7A.

The structures according to variations 1I-1K have the following effects in addition to the effects described in the first embodiment.

By forming the sponge 66 in a stepped shape according to variations 1I-1K, the amount of flexural deformation in the guide plate 61 can be varied at different positions in the paper conveying direction P thereof, thereby appropriately adjusting the flexural deformation in the guide plate 61.

Particularly, since the thickness of the sponge 66 is greater on the downstream end 61*c* of the guide plate 61 in variation 1I, the sponge 66 can effectively absorb flapping noise in the guide plate 61 produced at the downstream end 61*c*.

Further, since the surface area of the sponge 66 fixed to the deformable region TP of the guide plate 61 is minimized in variation 1J while the volume of the sponge 66 is increased, the guide plate 61 is able to bend sufficiently, while the sponge 66 can appropriately absorb vibrations in the guide plate 61.

Further, since the sponge 66 closely contacts the first seat 51*a* and second seat 51*b* in variation 1K, the sponge 66 can quickly damp vibrations in the guide plate 61. Further, since the distal end portion of the base part 66*a* has a cantilever structure, the guide plate 61 is allowed to bend sufficiently.

Figure 8A:
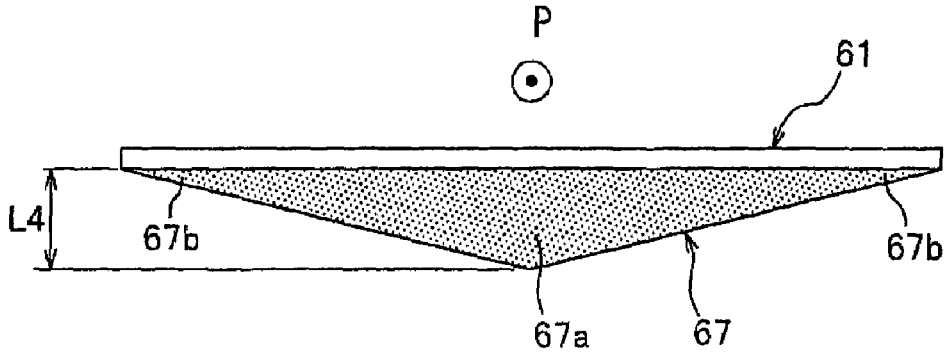
FIG. 8A is a view showing the structure of the guide plate as viewed from a photosensitive drum according to a variation 1L.
Figure 8B:
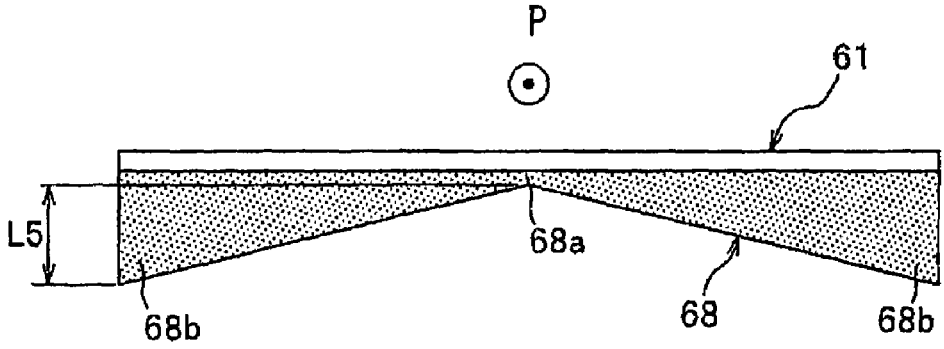
FIG. 8B is a view showing the structure of the guide plate as viewed from a photosensitive drum according to a variation 1M.

In variations 1L and 1M shown in FIGS. 8A and 8B, the thickness of the sponge 62 in the structure according to the first embodiment (see FIG. 2) is varied in the width direction. Specifically, in variation 1L shown in FIG. 8A, the thickness of a sponge 67 is formed gradually smaller from the center toward the widthwise outer edges, in other words, the thickness of the sponge 67 gets shorter toward the side edges from the center line between the side edges, producing a chevron shape in the bottom surface of the sponge 67. In variation 1M shown in FIG. 8B, the thickness of a sponge 68 is formed gradually larger from the center to the widthwise outer edges thereof, in other words, the thickness of the sponge 67 gets longer toward the side edges from the center line between the side edges, forming a V-shaped trough in the bottom surface of the sponge 68.

The structures according to variations 1L and 1M described above have the following effects in addition to the effects described in the first embodiment.

By forming the sponges 67 and 68 with downward facing chevron and V-shaped trough shapes, respectively, the amount of flexural deformation in the guide plate 61 can be varied at different positions in the width direction of the same, thereby varying the timing at which the paper 3 leaves the guide plate 61 at the center and widthwise sides. Accordingly, this construction can reduce flapping noise in the guide plate 61 produced when the paper 3 leaves the same. Further, since widthwise sides 67*b* and 68*b* on either side of widthwise centers 67*a* and 68*a*, respectively, are symmetrical, the force that the guide plate 61 applies to the paper 3 is balanced in the width direction, allowing the paper 3 to be conveyed without wavering in the width direction.

Figure 9:
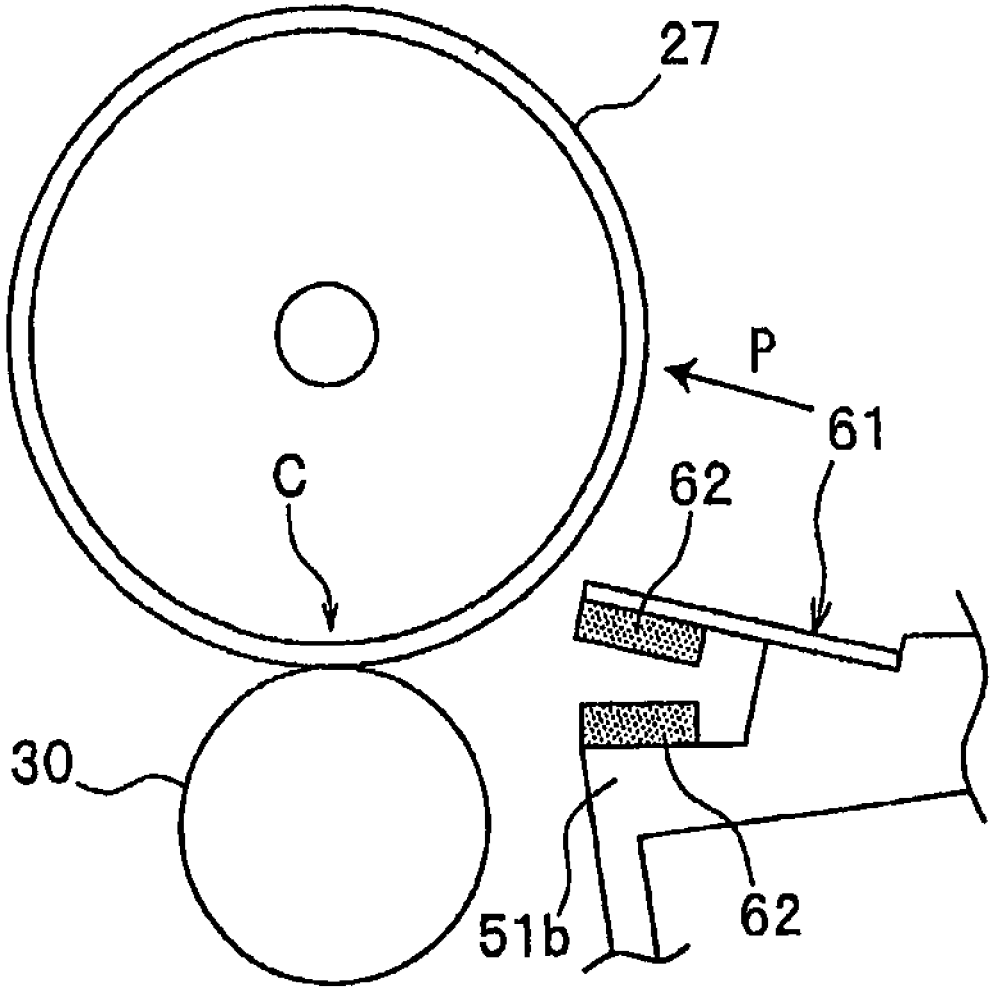
FIG. 9 is a cross-sectional view showing the structure near the transfer position according to a variation 1N.

FIG. 9 shows the structure around the transfer position C according to a variation 1N in which a second identical sponge 62 is disposed beneath the sponge 62 in the structure according to the first embodiment (see FIG. 2). Specifically, in variation 1N shown in FIG. 9, one of the sponges 62 is fixed to the guide plate 61, and the other to the second seat 51*b*. When the paper 3 passes over the guide plate 61, the sponge 62 fixed to the guide plate 61 contacts the top of the sponge 62 fixed to the second seat 51*b*.

The structure according to variation 1N described above has the following effects in addition to the effects described in the first embodiment.

Since the sponge 62 on the guide plate 61 contacts the sponge 62 on the second seat 51*b* when the paper 3 passes over the guide plate 61, the sponges 62 can more quickly damp vibrations in the guide plate 61. The same effects in variation 1N can be obtained by raising the top surface of the second seat 51*b* instead of providing the sponge 62 on the second seat 51*b* so that the sponge 62 on the guide plate 61 contacts the second seat 51*b* when the paper 3 passes over the guide plate 61.

Next, a second embodiment of the present invention will be described while referring to the accompanying drawings. The second embodiment of the present invention resolves the problems associated with the prior art by varying the thickness of the sponge in the paper conveying direction ND, rather than providing the sponge so as not to cover the entire deformable region TP, as described in the first embodiment. Further, since the second embodiment modifies only part of the structure around the transfer position C according to the first embodiment, like parts and components are designated with the same reference numerals to avoid duplicating description.

Figure 10:
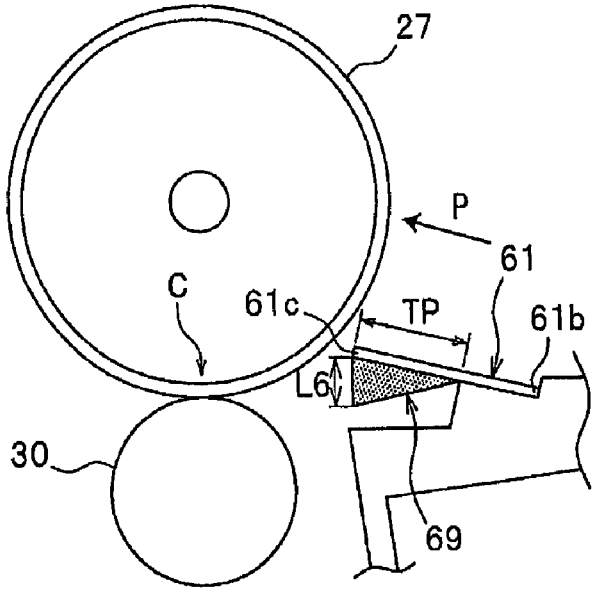
FIG. 10 is a cross-sectional view showing the structure near the transfer position according to a second variation.

In the structure according to the second embodiment shown in FIG. 10, a sponge 69 having a triangular cross-sectional shape is fixed to the entire surface of the deformable region TP in place of the sponge 62 described in the first embodiment. The sponge 69 is formed of a material that is softer than the guide plate 61 and has a thickness that gradually increases from the upstream side toward the downstream side thereof.

The structure according to the second embodiment described above has the following effects.

The sponge 69 provided on the guide plate 61 absorbs vibrations in the guide plate 61 when the trailing edge of the paper 3 leaves the guide plate 61, thereby suppressing flapping noise in the guide plate 61.

By forming the sponge 69 with a thickness that gradually increases from the upstream side toward the downstream side, the portion of the deformable region TP of the guide plate 61 bends easier on the base end portion 61*b* side. Hence, the guide plate 61 retains flexibility in this region, suppressing the occurrence of paper jams.

Further, since the thickest portion of the sponge 69 is located on the downstream end 61*c* of the guide plate 61, the sponge 69 can effectively absorb flapping noise produced by the downstream end 61*c* of the guide plate 61.

The present invention is not limited to the structure according to the second embodiment, but may be applied to any structure in which the thickness of the sponge is varied in the conveying direction. For example, the present invention may be applied to the following construction.

Figure 11:
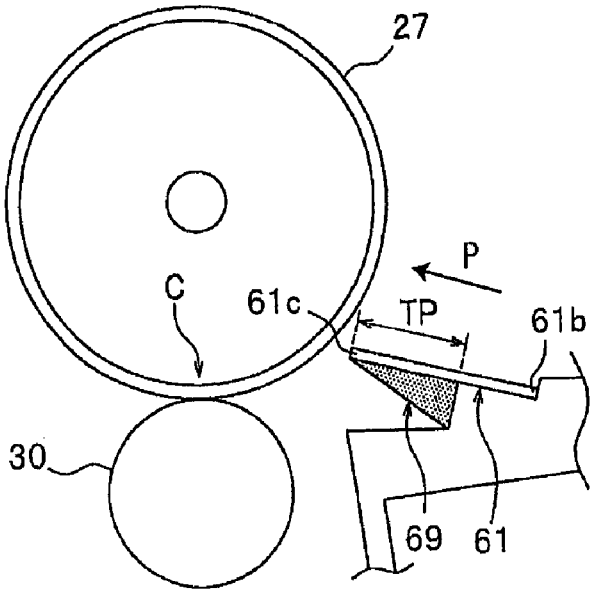
FIG. 11 is a cross-sectional view showing the structure near the transfer position according to a variation 2A.

FIG. 11 shows the structure around the transfer position C according to a variation 2A in which the orientation of the sponge 69 is reversed in the paper conveying direction P from that described in the second embodiment. Specifically, in variation 2A the thickness of the sponge 69 gradually decreases from the upstream side toward the downstream side.

The structure according to variation 2A has the following effects in addition to the effects described in the second embodiment for suppressing flapping noise and the occurrence of paper jams.

Since the thinnest region of the sponge 69 is positioned at the downstream end 61*c* of the guide plate 61, the guide plate 61 can bend easily at the downstream end 61*c* so that the paper 3 can be positioned sufficiently near the photosensitive drum 27.

The configuration of the second embodiment in which the thickness of the sponge is varied in the paper conveying direction P may also be appropriately combined with the first embodiment described above or any of the variations 1A-1N thereof.

Next, a third embodiment of the present invention will be described while referring to the accompanying drawings. The third embodiment of the present invention resolves the problems associated with the prior art by providing two or more types of sponges, rather than providing the sponge so as not to cover the entire deformable region TP, as described in the first embodiment. Further, since the third embodiment modifies only part of the structure around the transfer position C according to the first embodiment, like parts and components are designated with the same reference numerals to avoid duplicating description.

Figure 12:
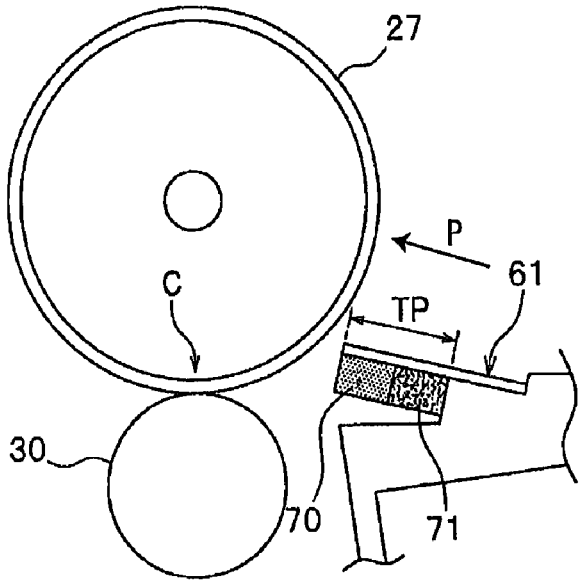
FIG. 12 is a cross-sectional view showing the structure near the transfer position according to a third variation.

FIG. 12 shows the structure around the transfer position C according to the third embodiment in which two types of sponges 70 and 71 juxtaposed in the paper conveying direction P are fixed to the entire surface of the deformable region TP in place of the sponge 62 according to the first embodiment. The sponges 70 and 71 are formed of materials having different levels of softness, both of which are softer than the guide plate 61. In the third embodiment, the material of the sponge 70 is softer than that of the sponge 71.

The structure of the third embodiment described above has the following effects. The sponges 70 and 71 provided on the guide plate 61 can absorb vibrations in the guide plate 61 produced when the trailing edge of the paper 3 leaves the guide plate 61, thereby suppressing flapping noise in the guide plate 61.

Forming the sponge 70 softer than the sponge 71 allows the guide plate 61 to bend more freely on the downstream end 61*c* to which the sponge 70 is fixed, thereby ensuring that this portion of the guide plate 61 can bend easily to suppress the occurrence of paper jams.

Further, since the downstream end 61*c* of the guide plate 61 can bend easily, the paper 3 can be placed suitably close to the photosensitive drum 27.

The third embodiment is particularly effective when both sponges do not have the same balance of softness and vibration-absorbing capacity. For example, it is effective to form the sponge 70 of a softer material that has a poor vibration-absorbing capacity, and to form the sponge 71 of a harder material that has a good vibration-absorbing capacity. Hence, by providing the sponge 70 and sponge 71 to exploit their own advantages and complement the others' disadvantages, the synergistic effect of both sponges can effectively resolve the problems associated with the prior art.

The present invention is not limited to the structure according to the third embodiment described above, but may be applied to any structure in which two or more types of sponges are provided. For example, the present invention may be applied to one of the following structures.

Figure 13:
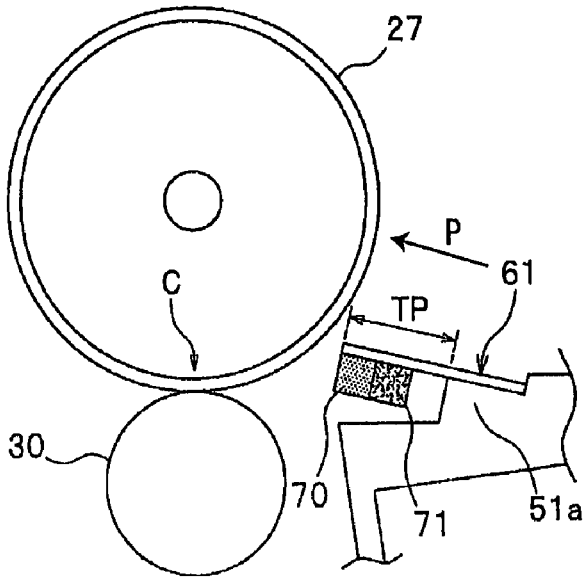
FIG. 13 is a cross-sectional view showing the structure near the transfer position according to a variation 3A.

FIG. 13 shows the structure around the transfer position C according to a variation 3A. Here, the lengths of the sponges 70 and 71 according to the third embodiment are shortened in the paper conveying direction P, forming a prescribed gap between the sponge 71 and the first seat 51*a*. Hence, in variation 3A, the two types of sponges 70 and 71 are provided on the guide plate 61, while leaving a portion of the deformable region TP on the guide plate 61 unoccupied.

The structure according to variation 3A described above has the following effects in addition to the effects described in the third embodiment for suppressing flapping noise and the occurrence of paper jams.

Since the guide plate 61 can easily bend in the portion of the deformable region TP at which the sponges 70 and 71 are not provided, the overall guide plate 61 can be made more flexible.

Figure 14:
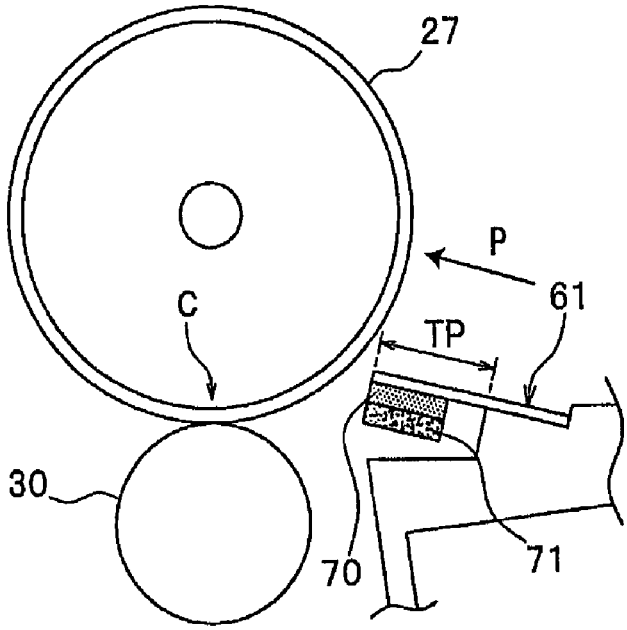
FIG. 14 is a cross-sectional view showing the structure near the transfer position according to a variation 3B.

FIG. 14 shows the structure around the transfer position C according to a variation 3B in which the sponges 70 and 71 are juxtaposed in a direction orthogonal to the guide plate 61. Specifically, in variation 3B the sponge 70 is fixed to the bottom surface of the guide plate 61, and the sponge 71 is fixed to the bottom surface of the sponge 70. The sponges 70 and 71 are disposed on the guide plate 61 so as to leave a portion of the deformable region TP in the guide plate 61 uncovered, as described in the first embodiment.

The structure according to variation 3B described above has the following effects in addition to the effects described in the first embodiment for suppressing flapping noise and the occurrence of paper jams.

By superimposing the sponges 70 and 71 having different degrees of stiffness, the sponges 70 and 71 are unlikely to resonate, thereby effectively suppressing vibrations in the guide plate 61.

Figure 15:
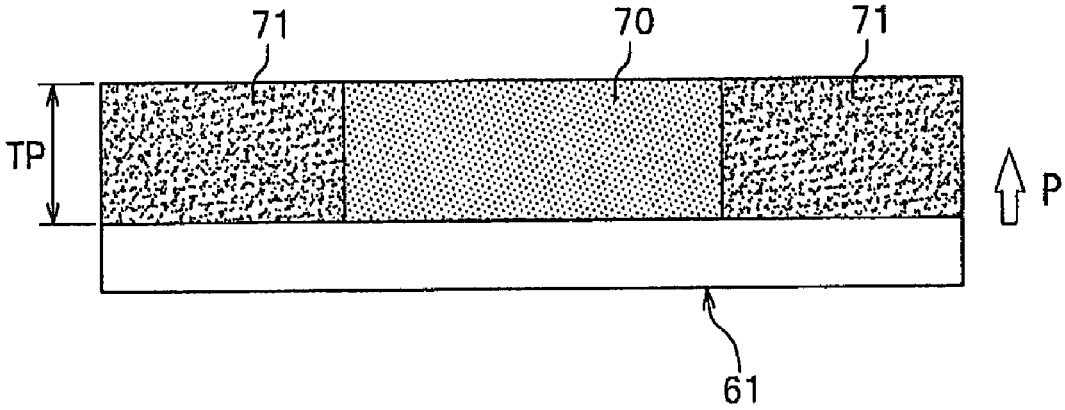
FIG. 15 is a rear view showing the structure of the guide plate according to a variation 3C.

In variation 3C shown in FIG. 15, the sponges 70 and 71 according to the third embodiment are juxtaposed along the width direction of the guide plate 61. More specifically, the sponge 70 is disposed in the central portion between the side edges of the guide plate 61, while the sponge 71 is disposed adjacent both widthwise sides of the sponge 70. The sponges 70 and 71 are arranged so as to cover the entire deformable region TP.

As in the third embodiment described above, the structure according to the variation 3C described above can suppress flapping noise and the occurrence of paper jams. By fixing the sponge 70 formed of a softer material than that of the sponge 71 to the widthwise center of the guide plate 61, the guide plate 61 can retain sufficient flexibility for suppressing paper jams.

Further, by juxtaposing two types of the sponges 70 and 71 having different levels of softness in the width direction of the guide plate 61, the amount of flexural deformation in the guide plate 61 can be varied at different positions along the width direction, thereby varying the timing at which the paper 3 leaves the guide plate 61 between the center region and the widthwise ends. Therefore, this construction can reduce flapping noise in the guide plate 61 when the paper 3 leaves the same. Further, since the sponge configuration is symmetrical about the widthwise center of the guide plate 61, the amount of force the guide plate 61 applies to the paper 3 is balanced in the width direction, allowing the paper 3 to be conveyed without wavering in the width direction.

While two types of sponges are used in the third embodiment described above and variations 3A-3C thereof, the present invention is not limited to this number and may be applied to a structure having three or more types of sponges.

Further, the positions of the sponges 70 and 71 in the third embodiment and the variations 3A-3C thereof may be interchanged.

Further, the configuration according to the third embodiment in which two or more types of sponges are provided on the guide plate may also be suitably combined with the structures described in the first and second embodiments or their variations 1A-1N and 2A.

In the preferred embodiment described above, the present invention is applied to the laser printer 1, but the present invention may also be applied to other image-forming devices, such as a photocopier or a multifunction device.

In the preferred embodiment described above, the photosensitive drum 27 serves as an example of the image-carrying member, but the image-carrying member may also be an intermediate transfer belt or a photosensitive belt for carrying toner, for example.

In the preferred embodiment described above, the sponge 62 serves as an example of the cushioning member, but the cushioning member may also be formed of rubber, felt, or the like.

In the preferred embodiment described above, the recording sheet is described as the paper 3, which may be a thick sheet, thin sheet, postcard, and the like, but the recording sheet in the present invention may also be a transparency, for example.

In the preferred embodiment described above, the feeding roller 8, paper dust rollers 10 and 11, and registration rollers 12 serve as an example of the conveying unit, but the present invention is not limited to any particular construction. For example, the conveying unit may be a mechanism for conveying paper inserted by hand through a manual feed tray to the transfer position.

In the preferred embodiment described above, the transfer roller 30 serves as the transferring unit, but the present invention is not limited to this configuration. For example, the transferring unit may be a non-contact type device.

In the preferred embodiment described above, the photosensitive drum 27 is disposed on the top side of the transfer position, and the transfer roller 30 is disposed on the bottom side thereof, but the arrangement of the photosensitive drum 27 and the transfer roller 30 in the present invention may be modified as desired. For example, the laser printer 1 may be configured with the photosensitive drum 27 on the bottom side of the transfer position and the transfer roller 30 on the top side, or with the photosensitive drum 27 on the left side and the transfer roller 30 on the right side.

In the preferred embodiment described above, the nip conveying direction ND follows the horizontal, but the nip conveying direction ND may be sloped relative to the horizontal, for example.

In the preferred embodiment described above, the guide plate 61 is disposed on the process cartridge 17 side, but the guide plate 61 may be disposed on the laser printer 1 side (the main body of the printer) instead.

In the preferred embodiment described above, the sponge 62 is disposed on the process cartridge 17 side, but the sponge 62 may be disposed on the laser printer 1 side (the main body of the printer) instead.

In the preferred embodiment described above, the first seat 51*a* is disposed on the process cartridge 17 side, but the first seat 51*a* may be disposed on the laser printer 1 side (the main body of the printer) instead.

In the preferred embodiment described above, the second seat 51*b* is disposed on the process cartridge 17 side, but the second seat 51*b* may be disposed on the laser printer 1 side (the main body of the printer) instead.

In the preferred embodiment described above, the transfer roller 30 is disposed on the process cartridge 17 side, but the transfer roller 30 may be disposed on the laser printer 1 side (the main body of the printer) instead.

In the preferred embodiment described above, the present invention is applied to a printer that charges toner with a positive polarity, but the present invention may also be applied to a printer that charges toner with a negative polarity.

Figure 16:
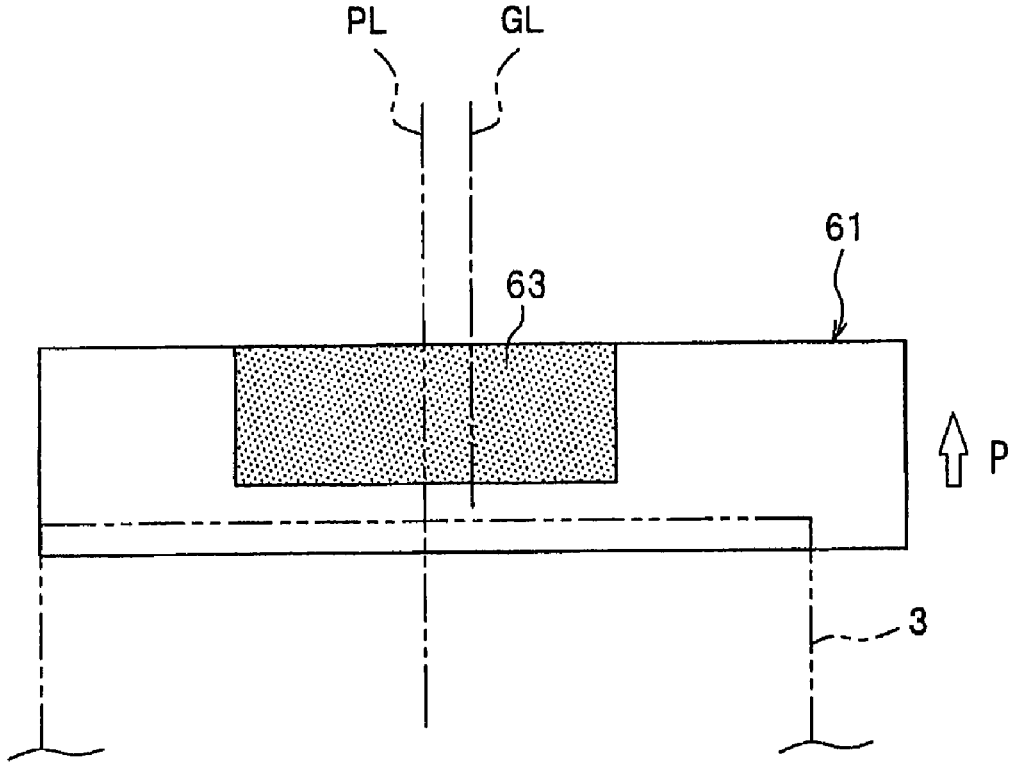
FIG. 16 is a rear view showing the structure of the guide plate according to another variation.

While the sponge 63 or the like is configured to be symmetrical about a widthwise center position (a widthwise center line GL shown in FIG. 16) of the guide plate 61 in the structures shown in FIGS. 5, 6, 8, and 15, the present invention is not limited to this configuration. For example, the sponge may be configured to be symmetrical about an actual widthwise center line PL (see FIG. 16) of the paper positioned on the guide plate. Since the basis for the structures in FIG. 5 and the like is an assumption that the paper 3 is conveyed such that the widthwise center GL of the guide plate 61 is aligned with the widthwise center line PL of the paper 3, the sponge 63 or the like is positioned symmetrically about the widthwise center line GL of the guide plate 61. However, if the paper 3 is conveyed such that the edge of the paper 3 is aligned with the edge of the guide plate 61 (i.e., the widthwise center lines GL and PL are not aligned), as shown in FIG. 16, the sponge 63 or the like should be disposed symmetrically about the widthwise center line PL of the paper 3.

Further, the length of the portion tp1 of the deformable region TP in the paper conveying direction P may be set to any arbitrary value, such as approximately 0.5 millimeters, between 1 and several millimeters, or between 1 and several centimeters.

Further, as shown in FIG. 2, the length of the portion tp1 of the deformable region TP in the paper conveying direction P may be set to any arbitrary value, such as approximately 0.5 millimeters, between 1 and several millimeters, or between 1 and several centimeters.

Further, as shown in FIG. 2, the thickness L1 of the sponge 62 may be set to any arbitrary value, such as approximately 0.5 millimeters, between 1 and several millimeters, or between 1 and several centimeters.

Further, as shown in FIGS. 6A and 6C, the height (length in the paper conveying direction P) L2 of the sponge 64 formed in a chevron shape may be set to any arbitrary value, such as approximately 0.5 millimeters, between 1 and several millimeters, or between 1 and several centimeters.

Further, as shown in FIGS. 6B and 6D, the depth (the length in the paper conveying direction P) L3 of the sponge 65 formed in a V-shaped may be set to any arbitrary value, such as approximately 0.5 millimeters, between 1 and several millimeters, or between 1 and several centimeters.

Further, as shown in FIG. 8A, the height (the maximum thickness) L4 of the sponge 67 formed in a chevron shape may be set to any arbitrary value, such as approximately 0.5 millimeters, between 1 and several millimeters, or between 1 and several centimeters.

Further, as shown in FIG. 8B, the depth (the difference value between maximum depth and minimum depth) L3 of the sponge 68 formed in a V-shaped may be set to any arbitrary value, such as approximately 0.5 millimeters, between 1 and several millimeters, or between 1 and several centimeters.

Further, as shown in FIG. 10, the maximum thickness L6 of the sponge 69 formed may be set to any arbitrary value, such as approximately 0.5 millimeters, between 1 and several millimeters, or between 1 and several centimeters.

The guide plate may also have one of the following constructions.

(1) The guide plate may be divided into a plurality of pieces that are arranged at prescribed intervals in the width direction of the paper. This configuration can reduce frictional drag between the paper and the guide plate, allowing the paper to be smoothly conveyed.

(2) One or a plurality of slits or notches extending in the paper-conveying direction may be formed in the downstream edge of the guide plate. With this construction, the guide plate can be mounted with greater precision and without wrinkling. In this example, holes may be formed at the root of the slit or the like, or the notches may be shaped substantially rectangular or substantially U-shaped, for example, to prevent the guide plate from splitting along the slits or notches.

(3) When the guide plate is formed according to a pressing process, the surface of the plate that is first contacted by the cutting blade in the pressing process, i.e. the shear-drooped side, has smooth or rounded edges, while the side opposite the shear-drooped side may have edges or burrs. Since the paper may catch on these burrs, the guide plate is preferably disposed with the shear-drooped side as the top surface that contacts the paper to ensure that the paper is smoothly conveyed.

What is claimed is:

1. An image-forming device comprising:

an image-carrying member that carries a developer image;

a transferring unit that is disposed in confrontation with the image-carrying member and transfers the developer image on the image-carrying member to a recording sheet;

a conveying unit that conveys the recording sheet to a transfer position between the image-carrying member and the transferring unit;

a guide plate having a first edge portion, a second edge portion, side edges, a first surface and a second surface opposite the first surface, the first edge portion including a first edge, the first edge portion being nearest to the image-carrying member and the second edge portion being farthest from image-carrying member, the first surface guiding the recording sheet toward the image-carrying member;

a seat that supports the guide plate, the second edge portion being fixed to the seat; and a cushioning member that is formed from a material softer than a material of the guide plate and disposed locally on the second surface to expose at least a part between the first edge and the second edge portion, wherein the cushioning member is fixed to the second surface of the guide plate, and is disposed closer to the first edge than to the second edge portion.

2. The image-forming device according to claim 1, wherein the cushioning member is symmetrical in shape with respect to a center plane orthogonal to the first surface and including a center line between the side edges.

3. The image-forming device according to claim 1, wherein the cushioning member is disposed on the first edge portion.

4. The image-forming device according to claim 2, wherein the cushioning member is disposed at a central portion between the side edges.

5. The image-forming device according to claim 2, wherein the cushioning member has a length in a paper conveying direction in which the recording sheet is conveyed along the first surface, the length getting shorter toward the side edges from the center line.

6. The image-forming device according to claim 2, wherein the cushioning member has a length in a paper conveying direction in which the recording sheet is conveyed along the first surface, the length getting longer toward the side edges from the center line.

7. The image-forming device according to claim 2, wherein the cushioning member has a thickness in a direction orthogonal to the second surface, the thickness getting smaller toward the side edges from the center line.

8. The image-forming device according to claim 2, wherein the cushioning member has a thickness in a direction orthogonal to the second surface, the thickness getting larger toward the side edges from the center line.

9. The image-forming device according to claim 2, wherein the cushioning member has a first portion and a second portion, the first portion being upstream of the second portion with respect to a paper conveying direction in which the recording sheet is conveyed along the first surface, the first portion having a first thickness and the second portion having a second thickness in a direction orthogonal to the second surface, the first thickness being smaller than the second thickness.

10. The image-forming device according to claim 2, wherein the cushioning member has a first portion and a second portion, the first portion being upstream of the second portion with respect to a paper conveying direction in which the recording sheet is conveyed along the first surface, the first portion having a first thickness and the second portion having a second thickness in a direction orthogonal to the second surface, the first thickness being larger than the second thickness.

11. The image-forming device according to claim 2, wherein the cushioning member is fixed to the seat.

12. The image-forming device according to claim 11, wherein the seat has a recessed portion to receive the cushioning member therein.

13. The image-forming device according to claim 2, further comprising another cushioning member, wherein the another cushioning member is fixed to the seat.

14. The image-forming device according to claim 1, wherein the cushioning member is formed of sponge.

15. The image-forming device according to claim 1, wherein the cushioning member is formed of rubber.

16. The image-forming device according to claim 1, wherein the guide plate is formed of a flexible material.

17. An image-forming device comprising:

an image-carrying member that carries a developer image;

a transferring unit that is disposed in confrontation with the image-carrying member and transfers the developer image on the carrying member to a recording sheet;

a conveying unit that conveys the recording sheet to a transfer position between the image-carrying member and the transferring unit;

a guide plate having a first edge portion, a second edge portion, a first surface and a second surface opposite the first surface, the first edge portion including a first edge, the first edge portion being nearest to the image-carrying member and the second edge portion being farthest from image-carrying member, the first surface guiding the recording sheet toward the image-carrying member;

a seat that supports the guide plate, the second edge portion being fixed to the seat; and a cushioning member that is formed from a material softer than a material of the guide plate, disposed on the second surface, and has a thickness in a direction orthogonal to the second surface, the thickness decreasing from the first edge toward the second edge portion, wherein the cushioning member is fixed to the second surface of the guide plate, and is disposed closer to the first edge than to the second edge portion.

18. An image-forming device comprising:

an image-carrying member that carries a developer image;

a transferring unit that is disposed in confrontation with the image-carrying member and transfers the developer image on the carrying member to a recording sheet;

a conveying unit that conveys the recording sheet to a transfer position between the image-carrying member and the transferring unit;

a guide plate having a first edge portion, a second edge portion, a first surface and a second surface opposite the first surface, the first edge portion including a first edge, the first edge portion being nearest to the image-carrying member and the second edge portion being farthest from image-carrying member, the first surface guiding the recording sheet toward the image-carrying member;

a cushioning member that is formed from a material softer than a material of the guide plate, disposed on the second surface, and has a thickness in a direction orthogonal to the second surface, the thickness increasing from the first edge toward the second edge portion.

19. An image-forming device comprising:

an image-carrying member that carries a developer image;

a transferring unit that is disposed in confrontation with the image-carrying member and transfers the developer image on the carrying member to a recording sheet;

a conveying unit that conveys the recording sheet to a transfer position between the image-carrying member and the transferring unit;

a guide plate having a first edge portion, a second edge portion, side edges, a first surface and a second surface opposite the first surface, the first edge portion including a first edge, the first edge portion being nearest to the image-carrying member and the second edge portion being farthest from image-carrying member, the first surface guiding the recording sheet toward the image-carrying member;

a seat that supports the guide plate, the second edge portion being fixed to the seat; and a plurality of cushioning members including a first cushioning member and a second cushioning member formed from a material softer than a material of the first cushioning member, each of the plurality of the cushioning members being formed from a material softer than a material of the guide plate, at least one of the plurality of cushioning members being disposed on the second surface and disposed closer to the first edge than to the second edge portion.

20. The image-forming device according to claim 19, wherein the plurality of the cushioning members is disposed on the second surface and juxtaposed in a paper conveying direction in which the recording sheet is conveyed on the first surface.

21. The image-forming device according to claim 19, wherein the plurality of the cushioning members is juxtaposed in a direction orthogonal to the second surface.

22. The image-forming device according to claim 19, wherein the plurality of the cushioning members is disposed on the second surface and juxtaposed along a width direction parallel to the first surface and orthogonal to a paper conveying direction in which the recording sheet is conveyed on the first surface, the first cushioning member being disposed at a central portion between the side edges, the second cushioning member being disposed adjacent both sides of the first cushioning member.

23. A process cartridge detachably mounted in an image-forming device, the process cartridge comprising:

a photosensitive drum that carries a developer image, the developer image being transferred to a recording sheet;

a conveying unit that conveys the recording sheet to a transfer position between the image-carrying member and the transferring unit;

a guide plate having a first edge portion, a second edge portion, side edges, a first surface and a second surface opposite the first surface, the first edge portion including a first edge, the first edge portion being nearest to the photosensitive drum and the second edge portion being farthest from photosensitive drum, the first surface guiding the recording sheet toward the photosensitive drum;

a seat that supports the guide plate, the second edge portion being fixed to the seat; and a cushioning member that is formed from a material softer than a material of the guide plate and disposed locally on the second surface to expose at least a part between the first edge and the second edge portion, wherein the cushioning member is fixed to the second surface of the guide plate, and is disposed closer to the first edge than to the second edge portion.

24. A process cartridge detachably mounted in an image-forming device, the process cartridge comprising:

a photosensitive drum that carries a developer image, the developer image being transferred to a recording sheet;

a conveying unit that conveys the recording sheet to a transfer position between the image-carrying member and the transferring unit;

a guide plate having a first edge portion, a second edge portion, side edges, a first surface and a second surface opposite the first surface, the first edge portion including a first edge, the first edge portion being nearest to the photosensitive drum and the second edge portion being farthest from photosensitive drum, the first surface guiding the recording sheet toward the photosensitive drum;

a cushioning member that is formed from a material softer than a material of the guide plate, disposed on the second surface, and has a thickness in a direction orthogonal to the second surface, the thickness increasing from the first edge toward the second edge portion.

25. A process cartridge detachably mounted in an image-forming device, the process cartridge comprising:

a photosensitive drum that carries a developer image, the developer image being transferred to a recording sheet;

a conveying unit that conveys the recording sheet to a transfer position between the image-carrying member and the transferring unit;

a guide plate having a first edge portion, a second edge portion, side edges, a first surface and a second surface opposite the first surface, the first edge portion including a first edge, the first edge portion being nearest to the photosensitive drum and the second edge portion being farthest from photosensitive drum, the first surface guiding the recording sheet toward the photosensitive drum;

a seat that supports the guide plate, the second edge portion being fixed to the seat; and a cushioning member that is formed from a material softer than a material of the guide plate, disposed on the second surface, and has a thickness in a direction orthogonal to the second surface, the thickness decreasing from the first edge toward the second edge portion, wherein the cushioning member is fixed to the second surface of the guide plate, and is disposed closer to the first edge than to the second edge portion.

26. A process cartridge detachably mounted in an image-forming device, the process cartridge comprising:

a photosensitive drum that carries a developer image, the developer image being transferred to a recording sheet;

a conveying unit that conveys the recording sheet to a transfer position between the image-carrying member and the transferring unit;

a guide plate having a first edge portion, a second edge portion, side edges, a first surface and a second surface opposite the first surface, the first edge portion including a first edge, the first edge portion being nearest to the photosensitive drum and the second edge portion being farthest from photosensitive drum, the first surface guiding the recording sheet toward the photosensitive drum;

a seat that supports the guide plate, the second edge portion being fixed to the seat; and a plurality of cushioning members including a first cushioning member and a second cushioning member formed from a material softer than a material of the first cushioning member, each of the plurality of the cushioning members being formed from a material softer than a material of the guide plate, at least one of the plurality of cushioning members being disposed on the second surface and disposed closer to the first edge than to the second edge portion.

* * * * *